US011539145B2

(12) United States Patent
Wu et al.

(10) Patent No.: US 11,539,145 B2
(45) Date of Patent: Dec. 27, 2022

(54) DUAL-POLARIZED ANTENNA

(71) Applicant: KUNSHAN HAMILTON COMMUNICATION TECHNOLOGY CO., LTD, Jiangsu (CN)

(72) Inventors: Zihan Wu, Jiangsu (CN); Congying Yan, Jiangsu (CN); Feng Sheng, Jiangsu (CN); Zhaoying Song, Jiangsu (CN)

(73) Assignee: KUNSHAN HAMILTON COMMUNICATION TECHNOLOGY CO., LTD, Jiangsu (CN)

( * ) Notice: Subject to any disclaimer, the term of this patent is extended or adjusted under 35 U.S.C. 154(b) by 5 days.

(21) Appl. No.: 17/273,832

(22) PCT Filed: Jun. 5, 2020

(86) PCT No.: PCT/CN2020/094690
§ 371 (c)(1),
(2) Date: Mar. 5, 2021

(87) PCT Pub. No.: WO2020/244636
PCT Pub. Date: Dec. 10, 2020

(65) Prior Publication Data

US 2021/0320431 A1 Oct. 14, 2021

(30) Foreign Application Priority Data

Jun. 6, 2019 (CN) ..... 201910490119.4

(51) Int. Cl.
*H01Q 21/24* (2006.01)
*H01Q 1/36* (2006.01)
(Continued)

(52) U.S. Cl.
CPC ..... *H01Q 21/24* (2013.01); *H01Q 1/36* (2013.01); *H01Q 13/04* (2013.01); *H01Q 13/085* (2013.01)

(58) Field of Classification Search
CPC ..... H01Q 21/24; H01Q 1/36; H01Q 13/04; H01Q 13/085
See application file for complete search history.

(56) References Cited

FOREIGN PATENT DOCUMENTS

CN 102709673 A 10/2012
CN 103887613 A * 6/2014 ..... H01Q 21/00
(Continued)

OTHER PUBLICATIONS

International Search Report issued in PCT/CN2020/094690, dated Aug. 28, 2020.

*Primary Examiner* — Hoang V Nguyen
(74) *Attorney, Agent, or Firm* — Barnes & Thornburg LLP; Jeffrey R. Stone

(57) ABSTRACT

Provided is a dual-polarized antenna. The dual-polarized antenna includes a horizontal radiating unit and a vertical radiating unit. The horizontal radiating unit includes a power divider and a Vivaldi oscillator array. The Vivaldi oscillator array includes multiple Vivaldi oscillator units uniformly distributed in a circumferential direction of the Vivaldi oscillator array. The power divider includes multiple output ports in one-to-one correspondence with the multiple Vivaldi oscillator units. The multiple output ports of the power divider are coupled to the multiple Vivaldi oscillator units in a one-to-one correspondence. The vertical radiating unit is disposed on one side of the horizontal radiating unit and includes a vertically-polarized oscillator.

7 Claims, 8 Drawing Sheets

(51) Int. Cl.
*H01Q 13/04* (2006.01)
*H01Q 13/08* (2006.01)

(56) References Cited

FOREIGN PATENT DOCUMENTS

| | | | | | |
|---|---|---|---|---|---|
| CN | 104993219 | A | * | 10/2015 | ..... H01Q 21/24 |
| CN | 105680171 | A | | 6/2016 | |
| CN | 206022610 | U | * | 3/2017 | ..... H01Q 9/04 |
| CN | 109193131 | A | | 1/2019 | |
| CN | 110197950 | A | | 9/2019 | |
| CN | 209804905 | U | | 12/2019 | |
| CN | 209948060 | U | * | 1/2020 | ..... H01Q 23/00 |
| WO | 2016/036043 | | | 3/2016 | |

* cited by examiner

DUAL-POLARIZED ANTENNA

This application is a U.S. National Stage Application of PCT Application Serial No. PCT/CN2020/094690, filed Jun. 5, 2020, which claims priority to Chinese Patent Application No. 201910490119.4 filed Jun. 6, 2019 with the CNIPA, the disclosures of which are incorporated herein by reference in their entireties.

TECHNICAL FIELD

Embodiments of this application relate to the technical field of antennas, for example, a dual-polarized antenna.

BACKGROUND

With the arrival of the era of the 5th-Generation mobile communication technology (5G), data in a request is larger and larger. In this case, the bandwidth of the communication system in the era of the third/fourth-Generation mobile communication (3G/4G) is unable to satisfy future communication requirements. The communication system needs a broader bandwidth, and accordingly, the bandwidth of multiple antennas also needs to be expanded. Moreover, a request for coverage of Wireless-Fidelity (WiFi) on various occasions is more and more popular. To save resources and reduce difficulties in network installation, multiple operators share the network. In this manner, the communication system needs a broader frequency band. Meanwhile, for the expansion of the communication system in the future, network constructors also hope to include the coverage of WiFi in the same network system. Therefore, the operators urgently need an ultra-wideband antenna.

At present, the coverage bandwidth of an antenna on the market is mostly 698-960 MHz or 1695-2700 MHz and the antenna has a very poor omnidirectional performance. Problems are described below. First, the coverage bandwidth is relatively narrow, which does not satisfy the requirements of the ultra-wideband. Moreover, due to the limitations of traditional design principles, the product is relatively large in size. Even if the size of the product can be made relatively small, the product performance is sacrificed in most cases and the omnidirectional characteristic of the antenna is also rather poor.

SUMMARY

This application provides a dual-polarized antenna. This dual-polarized antenna has the advantages of a relatively wide coverage bandwidth, a better omnidirectional performance, and miniaturization.

An embodiment of this application provides a dual-polarized antenna. The dual-polarized antenna includes a horizontal radiating unit and a vertical radiating unit.

The horizontal radiating unit includes a power divider and a Vivaldi oscillator array. The Vivaldi oscillator array includes multiple Vivaldi oscillator units uniformly distributed in a circumferential direction of the Vivaldi oscillator array. The power divider includes multiple output ports in one-to-one correspondence with the multiple Vivaldi oscillator units. The multiple output ports of the power divider are coupled to the multiple Vivaldi oscillator units in a one-to-one correspondence.

The vertical radiating unit is disposed on one side of the horizontal radiating unit and includes a vertically-polarized oscillator. The vertically-polarized oscillator is configured to be combined with the Vivaldi oscillator array so that the dual-polarization of the dual-polarized antenna can be achieved.

DETAILED DESCRIPTION

An embodiment of this application provides a dual-polarized antenna. This dual-polarized antenna includes a horizontal radiating unit and a vertical radiating unit.

The horizontal radiating unit includes a power divider and a Vivaldi oscillator array. The Vivaldi oscillator array includes multiple Vivaldi oscillator units uniformly distributed in a circumferential direction of the Vivaldi oscillator array. The power divider includes multiple output ports in one-to-one correspondence with the multiple Vivaldi oscillator units. The multiple output ports of the power divider are coupled to the multiple Vivaldi oscillator units in a one-to-one correspondence.

The vertical radiating unit is disposed on one side of the horizontal radiating unit and includes a vertically-polarized oscillator. The vertical radiating unit is configured to be combined with the Vivaldi oscillator array so that the dual-polarization of the dual-polarized antenna can be achieved.

The dual-polarized antenna provided in an embodiment of this application includes a horizontal radiating unit and a vertical radiating unit. The horizontal radiating unit includes a power divider and a Vivaldi oscillator array. The Vivaldi oscillator array includes multiple Vivaldi oscillator units uniformly distributed in a circumferential direction of the Vivaldi oscillator array. The power divider includes multiple output ports. The multiple output ports are coupled to the multiple Vivaldi oscillator units in a one-to-one correspondence. In this manner, the power divider is coupled to and feeds the Vivaldi oscillator units through the output ports so that the horizontal polarization can be achieved. The Vivaldi oscillator units have the advantages of a wide frequency band and a small size so that the dual-polarized antenna in a relatively small size covers a relatively wide bandwidth, thereby avoiding the case where the dual-polarized antenna in the related art has a relatively narrow coverage bandwidth. The vertical radiating unit includes a vertically-polarized oscillator disposed on one side of the horizontal radiating unit. The vertically-polarized oscillator can achieve the vertical polarization, and the Vivaldi oscillator array can achieve the horizontal polarization. Therefore, the antenna provided in this embodiment has the advantages of the dual-polarization, a high bandwidth, and relatively high performance.

Figure 1:
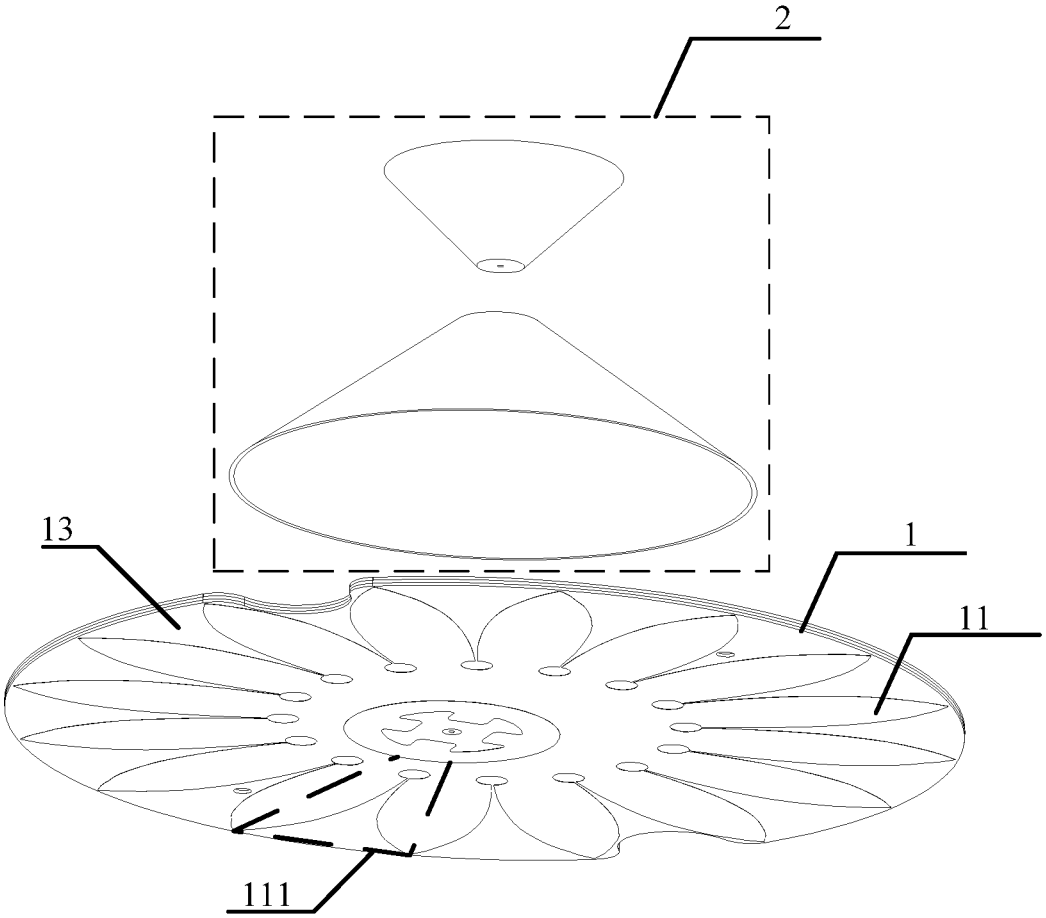
FIG. 1 is a bottom view of a dual-polarized antenna according to an embodiment of this application.
Figure 2:
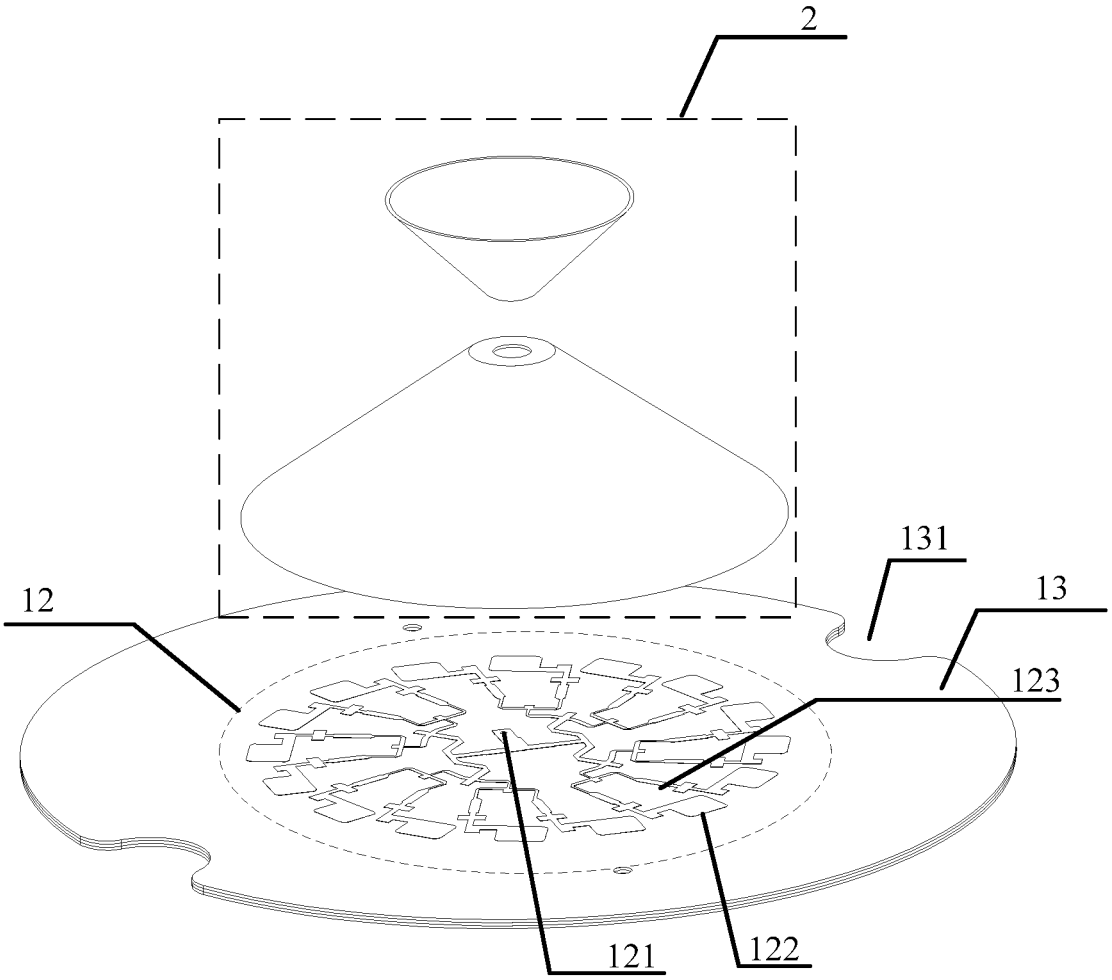
FIG. 2 is a top view of the dual-polarized antenna according to an embodiment of this application.

Referring to FIG. 1 and FIG. 2, FIG. 1 is a bottom view of a dual-polarized antenna according to an embodiment of this application, and FIG. 2 is a top view of a dual-polarized antenna according to an embodiment of this application. The dual-polarized antenna includes a horizontal radiating unit 1 and a vertical radiating unit 2. The bottom view and the top view described in this embodiment are based on the case where the vertical radiating unit 2 is disposed above the horizontal radiating unit 1. The horizontal radiating unit 1 for achieving the horizontal polarization includes a power divider 12 and a Vivaldi oscillator array 11. Referring to FIG. 2, the power divider 12 includes one input port 121 and multiple output ports 122. The power divider 12 receives a current signal through the input port 121 and distributes the current signal to the multiple output ports 122 for output through feeders 123. Exemplarily, the power divider 12 is an equal power divider, and evenly divides the current signal received through the input port 121 into equal parts with the same number of the output ports 122 so that each output port 122 can output the same current signal. Referring to FIG. 1, the Vivaldi oscillator array 11 includes multiple Vivaldi oscillator units 111 corresponding to the multiple output ports 122 one-to-one. The multiple Vivaldi oscillator units 111 are uniformly distributed in a circumferential direction of the Vivaldi oscillator array 11 so that the signals output by the output ports 122 can be uniformly radiated in the circumferential direction of the Vivaldi oscillator array 11 through the multiple Vivaldi oscillator units 111. Therefore, the dual-polarized antenna has a better omnidirectional characteristic. Moreover, the Vivaldi oscillator units 111 have a relatively wide coverage bandwidth, which enables the dual-polarized antenna to have the advantages of miniaturization and ultra-wideband.

Exemplarily, the ultra-wideband dual-polarized antenna provided in this embodiment can cover a bandwidth of 700-6000 MHz and cover a mobile communication frequency band and frequency bands such as World Interoperability for Microwave Access (WiMAX), WiFi, Global Positioning System (GPS), and Beidou Satellite Navigation System (BDS). In this manner, multiple operators can share the network, thereby saving resources and reducing difficulties in network installation.

The vertical radiating unit 2 includes a vertically-polarized oscillator that can achieve the vertical polarization. The vertical radiating unit 2 achieves the vertical polarization, and the horizontal radiating unit 1 achieves the horizontal polarization. Therefore, the dual-polarized antenna provided in this embodiment is a multiple-input and multiple-output (MIMO) antenna with a better omnidirectional performance. The vertical radiating unit 2 and the horizontal radiating unit 1 can achieve high-bandwidth signal transmission, respectively, which is conducive to the achievement of the functional integration of the dual-polarized antenna. Exemplarily, the horizontal radiating unit 1 may be configured to radiate signals outward, and the vertical radiating unit 2 may be configured to receive signals returned from the outside.

In this embodiment, each Vivaldi oscillator unit 111 is coupled to a corresponding output port 122, and the power divider 12 and the Vivaldi oscillator array 11 are separated by an insulation layer and fixedly disposed. As shown in FIG. 1, exemplarily, the insulation layer may be a substrate. In the case where the power divider 12 is located on one side of the substrate, the Vivaldi oscillator array 11 is located on another side of the substrate, then the horizontal radiating unit 1 in this embodiment may be a flat disk-shaped structure and has the advantages of ultra-thin, taking up small space, and strong versatility. As shown in FIG. 1 and FIG. 2, one side of the substrate of the horizontal radiating unit 1 is provided with the power divider 12, and another side of the substrate of the horizontal radiating unit 1 is provided with the Vivaldi oscillator array 11. The multiple Vivaldi oscillator units 111 are arranged in a circumferential direction of the Vivaldi oscillator array 11, forming a petal-shaped structure as shown in FIG. 1. The Vivaldi oscillator array 11 is formed by etching an entire metal layer 16, that is, adjacent Vivaldi oscillator units 111 are connected to each other. In an embodiment, eight, twelve or sixteen Vivaldi oscillator units 111 may be provided. Or, an odd number of, such as fifteen or seventeen, Vivaldi oscillator units 111 may be provided. Or, at least three Vivaldi oscillator units 111 may be provided as long as the Vivaldi oscillator units 111 can form a circle. The Vivaldi oscillator units 111 are uniformly distributed in a circumferential direction of the Vivaldi oscillator array 11. Within the achievable number range, the more Vivaldi oscillator units 111 are set, the higher the uniformity of radiation is.

Figure 3:
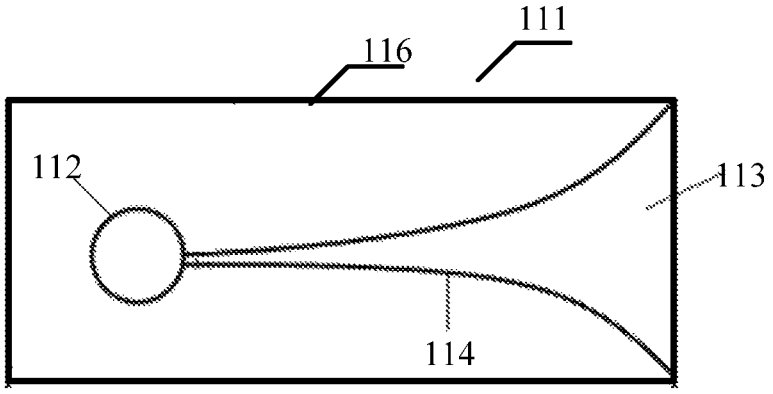
FIG. 3 is a structure view of a Vivaldi oscillator unit according to an embodiment of this application.

In an embodiment, referring to FIG. 3, FIG. 3 is a structure view of a Vivaldi oscillator unit according to an embodiment of this application. The Vivaldi oscillator unit 111 may include a resonant cavity 112 formed by etching a metal layer 16 and a dielectric substrate 113 communicating with the resonant cavity 112. A radiation area is defined by an exponential gradient trough line 114, a rectangular trough line 116, and the resonant cavity 112. Each output port 122 of the power divider 12 is disposed corresponding to the resonant cavity 112 of a respective Vivaldi oscillator unit 111. Referring to FIG. 1, it can be seen that in the direction perpendicular to the substrate, the output ports 122 are coupled to the resonant cavities 112 in a one-to-one correspondence, so as to facilitate feeding the Vivaldi oscillator units 111 through the output ports 122. The feed signal resonates through the resonant cavity 112, and then is amplified and radiated through the dielectric substrate 113, so that directional radiation can be produced. The Vivaldi oscillator units 111 performing directional radiation surround a circle by 360 degrees so that the Vivaldi oscillator array 11 can achieve omnidirectional radiation.

For the entire Vivaldi oscillator array 11, the entire metal layer 16 may be etched so that hollow structures are formed, and thus the resonant cavity 112 and the dielectric substrate 113 of each Vivaldi oscillator unit 111 are formed. The exponential gradient trough line 114 and the rectangular trough line 116 are the edges of a respective and hollow dielectric substrate 113.

In an embodiment, the resonant cavity 112 may be circular, elliptical, or rectangular. FIG. 3 only shows that the resonant cavity 112 has a circular structure. The resonant cavity 112 may also be elliptical, rectangular, or other regular or irregular shapes set according to user requirements.

Figure 4:
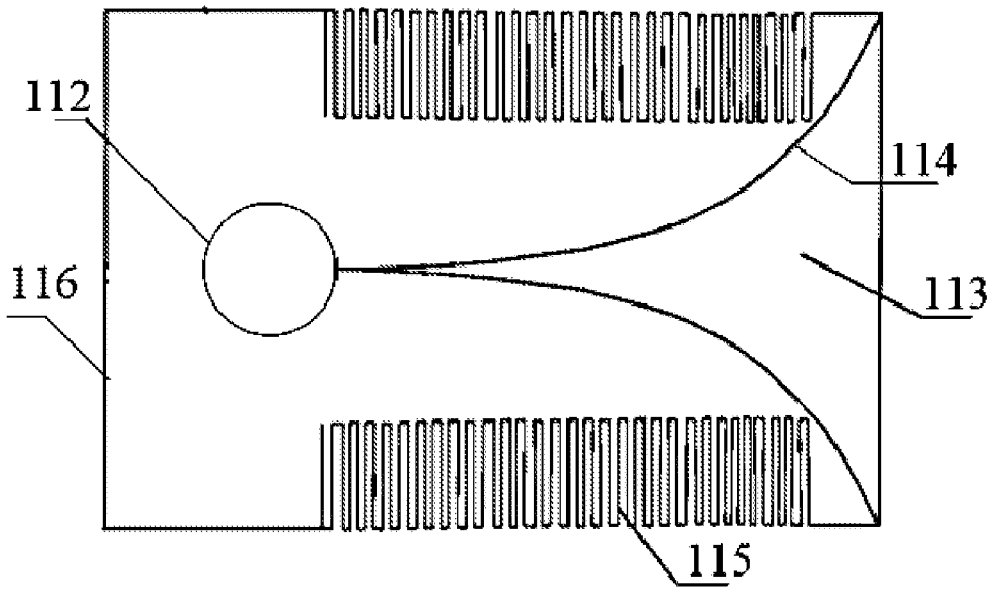
FIG. 4 is a structure view of another Vivaldi oscillator unit according to an embodiment of this application.

In an embodiment, referring to FIG. 4, FIG. 4 is a structure view of another Vivaldi oscillator unit according to an embodiment of this application. The rectangular trough line 116 of each Vivaldi oscillator unit 111 is provided with multiple rectangular corrugated grooves 115. That is to say, the edge of the Vivaldi oscillator units 111, that is, the metal layer 16 between two adjacent Vivaldi oscillator units 111, may be etched to form the multiple rectangular corrugated grooves 115. Slotting the rectangular trough line 116 of the Vivaldi oscillator unit 111 has the following advantages: first, the current path can be extended, the generation of surface waves can be suppressed, and thus the minimum operating frequency of the antenna can be reduced and the operating frequency band of the antenna can be expanded; second, high-order harmonics can be suppressed so that higher gain and narrower beams can be produced. In this embodiment, the rectangular corrugated grooves 115 are etched at the edge of the Vivaldi oscillator unit 111 so that the bandwidth of the dual-polarized antenna can be expanded and the performance of the dual-polarized antenna can be optimized.

In an embodiment, referring to FIG. 1 and FIG. 2, the horizontal radiating unit 1 may further include a first substrate 13. The Vivaldi oscillator array 11 is disposed on the first side of the first substrate 13. The power divider 12 is disposed on the second side of the first substrate 13 facing away from the Vivaldi oscillator array 11.

The horizontal radiating unit 1 may include one substrate, namely the first substrate 13. As shown in FIG. 2 and FIG. 3, the Vivaldi oscillator array 11 is disposed on the first side of the first substrate 13. The power divider 12 is disposed on the second side of the first substrate 13 facing away from the Vivaldi oscillator array 11. In this manner, the Vivaldi oscillator array 11 and the power divider 12 are disposed on the same substrate so that the overall thickness of the horizontal radiating unit 1 can be reduced. At least a pair of positioning grooves 131 may be disposed at the edge of the first substrate 13. The positioning grooves 131 are configured to fix the position of the horizontal radiating unit 1 during installing the horizontal radiating unit 1.

Figure 5:
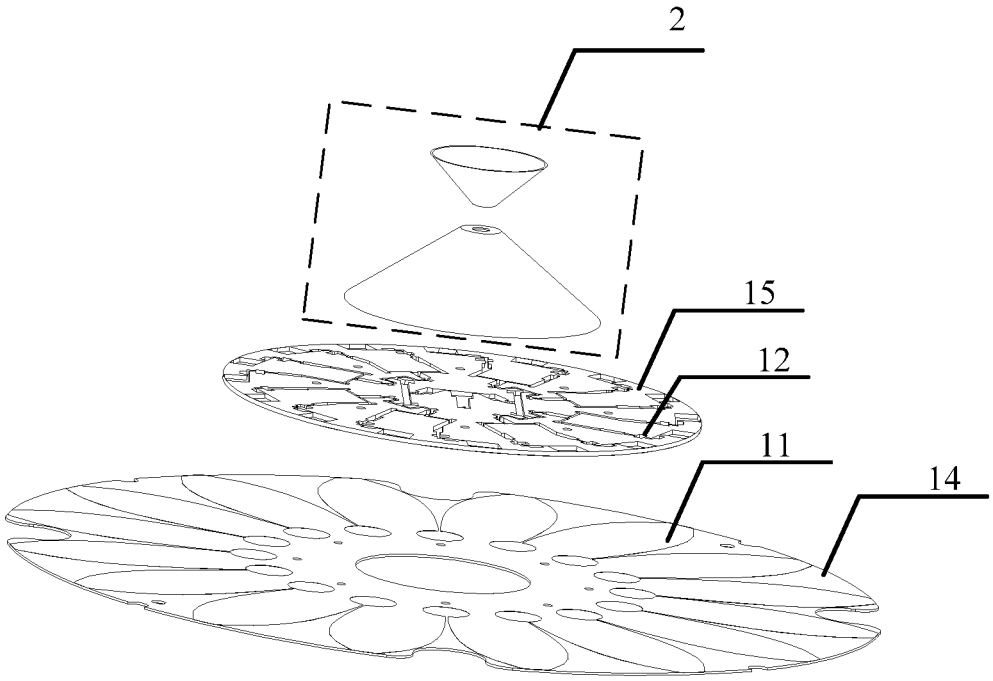
FIG. 5 is an exploded view of another dual-polarized antenna according to an embodiment of this application.
Figure 6:
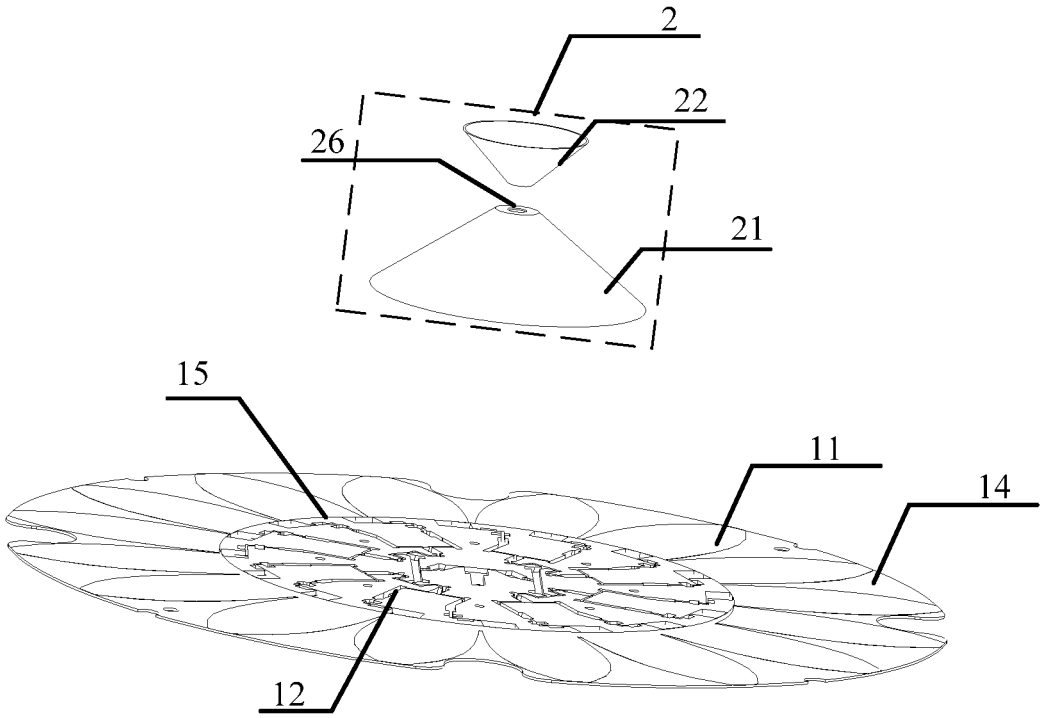
FIG. 6 is a structure view of the another dual-polarized antenna according to an embodiment of this application.

In an embodiment, as shown in FIG. 5 and FIG. 6, FIG. 5 is an exploded view of another dual-polarized antenna according to an embodiment of this application, and FIG. 6 is a structure view of the another dual-polarized antenna according to an embodiment of this application. The horizontal radiating unit may further include a second substrate 14 and a third substrate 15. The second substrate 14 and the third substrate 15 are fixedly connected. The Vivaldi oscillator array 11 is disposed on the second substrate 14. The power divider 12 is disposed on the third substrate 15.

The horizontal radiating unit 1 may further include two substrates, namely the second substrate 14 and the third substrate 15. The Vivaldi oscillator array 11 is disposed on the second substrate 14. The power divider 12 is disposed on the third substrate 15. That is, the Vivaldi oscillator array 11 and the power divider 12 are disposed on different substrates, respectively. The power divider 12 and the Vivaldi oscillator array 11 may be integrated and fabricated on the respective substrates, and then the second substrate 14 and the third substrate 15 are fixedly assembled so that the production speed can be sped up. Exemplarily, the second substrate 14 and the third substrate 15 may be screwed together by screws or may be riveted by rivets.

Moreover, the main factor that affects the bandwidth performance is the power divider 12. The power divider 12 has relatively high performance requirements for the third substrate 15 on which the power divider 12 is located, and therefore the manufacturing cost of the third substrate 15 is relatively high. The Vivaldi oscillator array 11 has relatively low performance requirements for the second substrate 14 and the second substrate 14 with a relatively low cost may be used so that the production cost of the horizontal radiating unit 1 can be reduced. Exemplarily, in order to reduce the substrate material cost of the horizontal radiating unit 1, the diameter of the third substrate 15 may be set to be less than the diameter of the second substrate 14. Exemplarily, the first substrate 13, the second substrate 14, and the third substrate 15 may be printed circuit boards (PCB).

In an embodiment, referring to FIG. 5 and FIG. 6, the Vivaldi oscillator array 11 is disposed on the first side of the second substrate 14 facing toward the third substrate 15, and the power divider 12 is disposed on the first side of the third substrate 15 facing away from the second substrate 14.

The Vivaldi oscillator array 11 is disposed on the first side of the second substrate 14 facing toward the third substrate 15, and the power divider 12 is disposed on the first side of the third substrate 15 facing away from the second substrate 14. In this manner, the Vivaldi oscillator array 11 and the power divider 12 are spaced by only the third substrate 15 so that a better coupling effect can be ensured and the radiation intensity of the electrical signal can be increased. In an embodiment, the Vivaldi oscillator array 11 may also be disposed on the second side of the second substrate 14 facing away from the third substrate 15, and the power divider 12 may be disposed on the first side of the third substrate 15 facing away from the second substrate 14. In this manner, the Vivaldi oscillator array 11 and the power divider 12 are spaced by the second substrate 14 and the third substrate 15. This embodiment does not limit the locations of the Vivaldi oscillator array 11 and the power divider 12.

In an embodiment, as shown in FIGS. 9-12, the horizontal radiating unit 1 may further include a second cable 4, the inner conductor 41 of the second cable 4 passes through the Vivaldi oscillator array 11 and is electrically connected to the power divider 12, and the outer conductor 42 of the second cable 4 is electrically connected to the Vivaldi oscillator array 11. The second cable 4 enables the horizontal radiating unit 1 to form a signal transmission path so that the horizontally-polarized horizontal radiating unit 1 provided in an embodiment of this application can be achieved. In the horizontal direction parallel to the substrate, the horizontal radiating unit 1 provided in this embodiment has uniform radiation and a better omnidirectional characteristic.

In the case where the horizontal radiating unit 1 includes only the first substrate 13, the second cable 4 is accessed from the one side of the first substrate 13 where the Vivaldi oscillator array 11 is provided, the outer conductor 42 of the second cable 4 is directly electrically connected to the metal layer 16 in the middle of the Vivaldi oscillator array 11, and the inner conductor 41 of the second cable 4 passes through the first substrate 13 and is electrically connected to the input port of the power divider 12 on the other side of the first substrate 13.

In the case where the horizontal radiating unit 1 includes a second substrate 14 and a third substrate 15, the Vivaldi oscillator array 11 is disposed on one side of the second substrate 14 facing toward the third substrate 15, and the power divider 12 is disposed on one side of the third substrate 15 facing away from the second substrate 14, then the second cable 4 is accessed from one side of the second substrate 14 facing away from the third substrate 15, the outer conductor 42 of the second cable 4 passes through the second substrate 14 and is directly electrically connected to the metal layer 16 in the middle of the Vivaldi oscillator array 11, and the inner conductor 41 of the second cable 4 passes through the second substrate 14 and the third substrate 15 and is electrically connected to the input port of the power divider 12 on one side of the third substrate 15 facing away from the second substrate 14.

Figure 7:
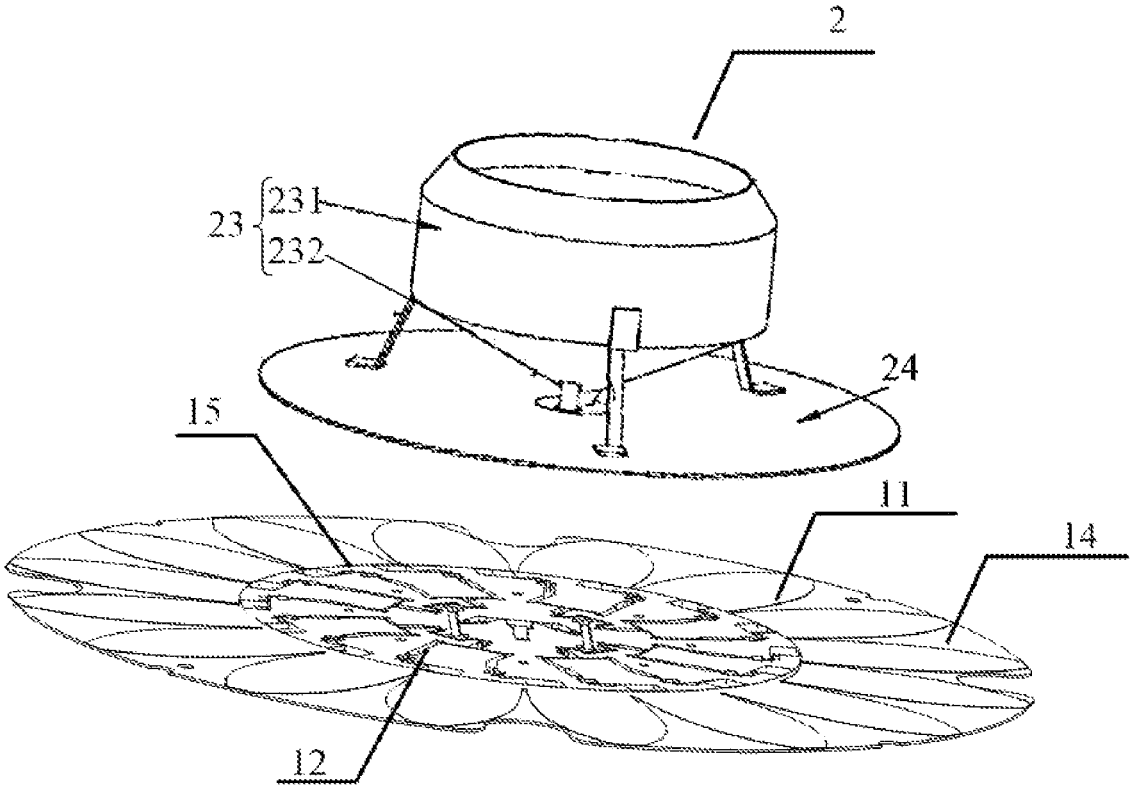
FIG. 7 is a structure view of another dual-polarized antenna according to an embodiment of this application.
Figure 8:
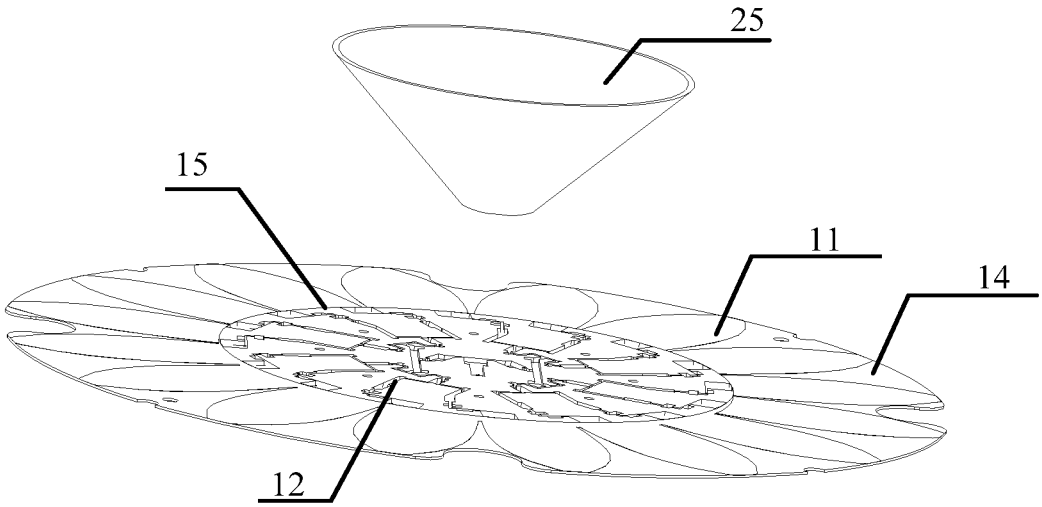
FIG. 8 is a structure view of still another dual-polarized antenna according to an embodiment of this application.
Figure 9:
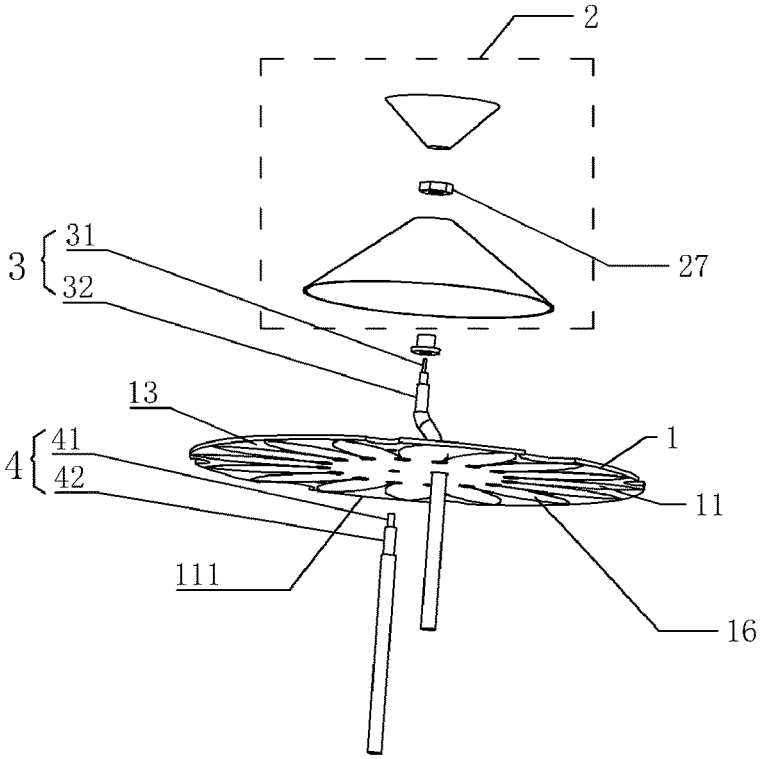
FIG. 9 is a structure view of the dual-polarized antenna in FIG. 1 with cables.
Figure 10:
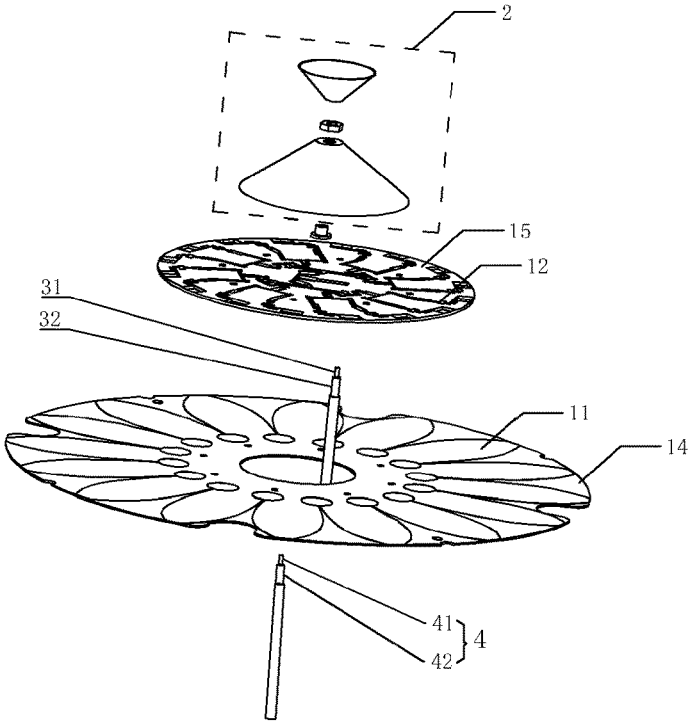
FIG. 10 is a structure view of the dual-polarized antenna in FIG. 5 with cables.
Figure 11:
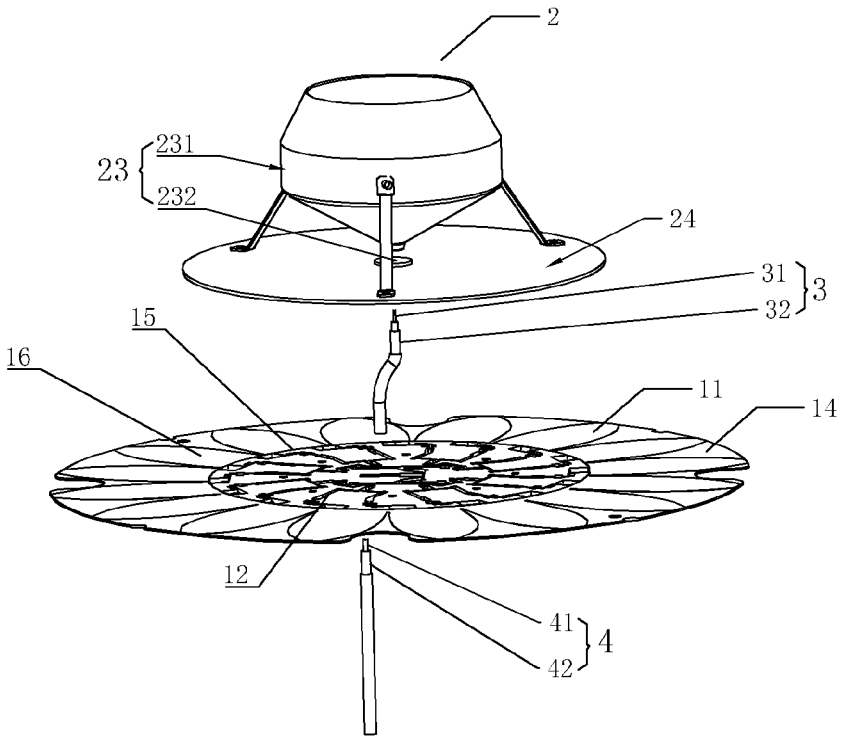
FIG. 11 is a structure view of the dual-polarized antenna in FIG. 7 with cables.
Figure 12:
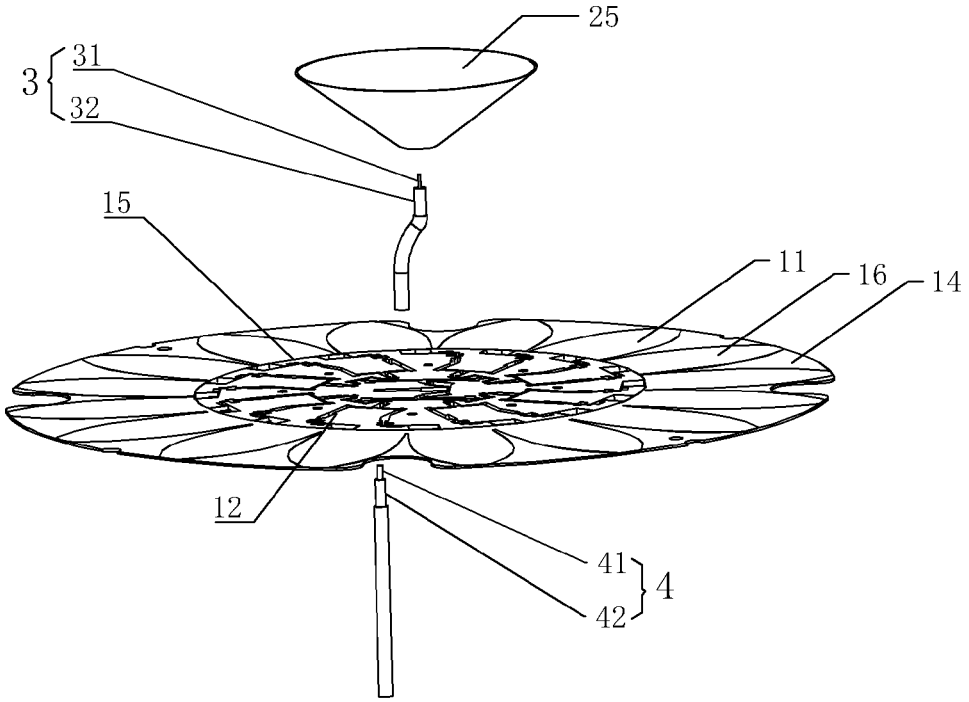
FIG. 12 is a structure view of the dual-polarized antenna in FIG. 8 with cables.

FIG. 7 is a structure view of another dual-polarized antenna according to an embodiment of this application, and FIG. 8 is a structure view of still another dual-polarized antenna according to an embodiment of this application. Referring to FIGS. 6 to 8, exemplarily, the vertically-polarized oscillator 2 may be a single-cone oscillator, a shaped-cone oscillator, or a biconical oscillator. FIG. 6 shows a structure of the vertically-polarized oscillator 2 being a biconical oscillator. The vertically-polarized oscillator 2 includes two cone oscillators that are oppositely disposed, namely a first cone oscillator 21 and a second cone oscillator 22. FIG. 7 shows a structure of the vertically-polarized oscillator 2 being a shaped-cone oscillator 23. The shaped-cone oscillator 23 includes a cone portion 232 whose a top end faces toward the horizontal radiating unit 1 and a barrel portion 231 connected to the tail end of the cone portion. Moreover, the shaped-cone oscillator 23 further includes a reflector 24 disposed on the cone portion 232 facing toward the horizontal radiating unit 1. FIG. 8 shows a structure of the vertically-polarized oscillator 2 being a single-cone oscillator 25. The structures of the vertical-polarized oscillator 2 shown in FIGS. 6 to 8 are only a few configuration forms of the vertically-polarized oscillator 2 provided in an embodiment of this application. In addition to the single-cone oscillator, the shaped-cone oscillator, or the biconical oscillator, the vertical-polarized oscillator 2 of the dual-polarized antenna provided in this embodiment may also be other types of vertically-polarized oscillators, and this embodiment does not limit the type of the vertically-polarized oscillator 2.

In an embodiment, referring to FIG. 6, the vertically-polarized oscillator 2 is a biconical oscillator. The biconical oscillator includes a first cone oscillator 21 and a second cone oscillator 22. The top end of the first cone oscillator 21 and the top end of the second cone oscillator 22 are oppositely disposed, and the top end of the first cone oscillator 21 is insulated from and connected to the top end of the second cone oscillator 22 through a supporting portion 27. The first cone oscillator 21 is disposed facing toward the horizontal radiating unit 1, and the second cone oscillator 22 is disposed facing away from the horizontal radiating unit 1. The top end of the first cone oscillator 21 and the top end of the second cone oscillator 22 each are provided with a wiring hole 26.

Compared with the shaped-cone oscillator or the single-cone oscillator, the biconical oscillator has better radiation performance and covers a relatively wide bandwidth so that the ultra-wideband dual-polarized antenna can be achieved. The top end of the first cone oscillator 21 and the top end of the second cone oscillator 22 are oppositely disposed. It is worth noting that in this embodiment, the top end of the first cone oscillator 21 and the top end of the second cone oscillator 22 refer to the sides of the cones with a smaller cross-sectional diameter, respectively, and the bottom end of the first cone oscillator 21 and the bottom end of the second cone oscillator 22 are the sides of the cones with a larger cross-sectional diameter, respectively. The bottom end of the first cone oscillator 21 is disposed facing toward the horizontal radiating unit 1, the top end of the first cone oscillator 21 is disposed facing toward the top end of the second cone oscillator 22, and the bottom end of the second cone oscillator 22 is disposed facing away from the horizontal radiating unit 1, that is, facing away from the first cone oscillator 21. The top end of the first cone oscillator 21 is insulated from the top end of the second cone oscillator 22. For example, a plastic supporting portion 27 may be used for achieving the support between the top end of the first cone oscillator 21 and the top end of the second cone oscillator 22.

In an embodiment, as shown in FIGS. 9-12, the vertical radiating unit 2 further includes a first cable 3, the inner conductor 31 of the first cable 3 passes through the wiring hole 26 of the first cone oscillator 21 and the wiring hole 26 of the second cone oscillator 22 and is electrically connected to the second cone oscillator 22, and the outer conductor 32 of the first cable 3 is electrically connected to the first cone oscillator 21. The first cable 3 enables the vertically-polarized oscillator 2 to form a signal transmission path. In the direction perpendicular to the horizontal radiating unit 1, the vertically-polarized vertically-polarized oscillator 2 provided in an embodiment of this application has uniform radiation, and thus has a better omnidirectional characteristic.

In the case where the horizontal radiating unit 1 includes only the first substrate 13, the first cable 3 is accessed from the one side of the first substrate 13 where the Vivaldi oscillator array 11 is provided. After the first cable 3 passes through the first substrate 13, the inner conductor 31 of the first cable 3 passes through the wiring hole 26 of the first cone oscillator 21 and the wiring hole 26 of the second cone oscillator 22 and is electrically connected to the second cone oscillator 22, and the outer conductor 32 of the first cable 3 is electrically connected to the first cone oscillator 21.

In the case where the horizontal radiating unit 1 includes the second substrate 14 and the third substrate 15, the first cable 3 is accessed from the one side of the second substrate 14 facing away from the third substrate 15. After the first cable 3 passes through the second substrate 14 and the third substrate 15, the inner conductor 31 of the first cable 3 passes through the wiring hole 26 of the first cone oscillator 21 and the wiring hole 26 of the second cone oscillator 22 and is electrically connected to the second cone oscillator 22, and the outer conductor 32 of the first cable 3 is electrically connected to the first cone oscillator 21.

What is claimed is:

1. A dual-polarized antenna, comprising: a horizontal radiating unit and a vertical radiating unit, wherein the horizontal radiating unit comprises a power divider and a Vivaldi oscillator array; the Vivaldi oscillator array comprises a plurality of Vivaldi oscillator units uniformly distributed in a circumferential direction of the Vivaldi oscillator array; the power divider comprises a plurality of output ports in one-to-one correspondence with the plurality of Vivaldi oscillator units; and the plurality of output ports of the power divider are coupled to the plurality of Vivaldi oscillator units in a one-to-one correspondence; and the vertical radiating unit is disposed on one side of the horizontal radiating unit and comprises a vertically-polarized oscillator, and the vertically-polarized oscillator is configured to be combined with the Vivaldi oscillator array;

wherein the horizontal radiating unit further comprises a first substrate and a second substrate fixedly connected to each other; and wherein the Vivaldi oscillator array is disposed on a side of the first substrate facing the second substrate; and the power divider is disposed on a side of the second substrate facing away from the first substrate, such that the Vivaldi oscillator array and the power divider are spaced by only the first substrate; and the second substrate on which the power divider is disposed has a higher cost than the first substrate and a diameter that is less than that of the first substrate.

2. The dual-polarized antenna of claim 1, wherein the vertically-polarized oscillator is a single-cone oscillator, a shaped-cone oscillator, or a biconical oscillator.

3. The dual-polarized antenna of claim 2, wherein the vertically-polarized oscillator is a biconical oscillator; the biconical oscillator comprises a first cone oscillator and a second cone oscillator; a top end of the first cone oscillator and a top end of the second cone oscillator are oppositely disposed, and the top end of the first cone oscillator is insulated from and connected to the top end of the second cone oscillator through a supporting portion; and the first cone oscillator is disposed facing toward the horizontal radiating unit, and the second cone oscillator is disposed facing away from the horizontal radiating unit; and the top end of the first cone oscillator and the top end of the second cone oscillator are respectively provided with a wiring hole.

4. The dual-polarized antenna of claim 3, wherein the vertical radiating unit further comprises a first cable; an inner conductor of the first cable passes through the wiring hole of the first cone oscillator and the wiring hole of the second cone oscillator and is electrically connected to the second cone oscillator; and an outer conductor of the first cable is electrically connected to the first cone oscillator.

5. The dual-polarized antenna of claim 1, wherein each of the plurality of Vivaldi oscillator units comprises a resonant cavity formed by etching a metal layer and a dielectric substrate in communication with the resonant cavity; and a radiation area is defined by an exponential gradient trough line, a rectangular trough line, and the resonant cavity.

6. The dual-polarized antenna of claim 5, wherein the rectangular trough line of the each of the plurality of Vivaldi oscillator units is provided with a plurality of rectangular corrugated grooves.

7. The dual-polarized antenna of claim 1, further comprising a second cable, wherein an inner conductor of the second cable passes through the Vivaldi oscillator array and is electrically connected to the power divider; and an outer conductor of the second cable is electrically connected to the Vivaldi oscillator array.

* * * * *